US008754588B2

(12) United States Patent
Minaki et al.

(10) Patent No.: US 8,754,588 B2
(45) Date of Patent: Jun. 17, 2014

(54) ILLUMINATION APPARATUS

(75) Inventors: Sinsuke Minaki, Niigata (JP); Jun Matsuzaki, Niigata (JP); Tadahiro Kono, Niigata (JP); Koji Yamashita, Niigata (JP); Hiroyuki Matsumoto, Osaka (JP); Atusi Ootubo, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/563,173

(22) Filed: Jul. 31, 2012

(65) Prior Publication Data

US 2013/0063038 A1 Mar. 14, 2013

(30) Foreign Application Priority Data

Sep. 12, 2011 (JP) ..... 2011-198278

(51) Int. Cl.
*H05B 37/02* (2006.01)

(52) U.S. Cl.
USPC ..... 315/294; 315/185 R; 315/201

(58) Field of Classification Search
USPC ..... 315/185 R, 200 R, 201, 291, 294, 297, 315/312; 362/249.02, 249.11, 800
See application file for complete search history.

(56) References Cited

U.S. PATENT DOCUMENTS 8,587,217 B2 * 11/2013 Melanson ..... 315/294
2006/0171135 A1 8/2006 Ishizaka et al.
2008/0074058 A1 * 3/2008 Lee et al. ..... 315/291
2008/0265795 A1 * 10/2008 Hente et al. ..... 315/291
2011/0133660 A1 6/2011 Tomita et al.
2011/0211353 A1 9/2011 Allen
2011/0270935 A1 11/2011 Tozaki et al.

FOREIGN PATENT DOCUMENTS

| | | |
|---|---|---|
| JP | 2004-039288 | 2/2004 |
| JP | 2005-072546 | 3/2005 |
| JP | 2006-222412 | 8/2006 |
| JP | 2010-040170 | 2/2010 |
| JP | 2010-199522 | 9/2010 |
| JP | 2011-100716 | 5/2011 |

OTHER PUBLICATIONS

European Search Report for corresponding European Application No. 12178770.9 dated Dec. 7, 2012.

* cited by examiner

*Primary Examiner* — Tung X Le
(74) *Attorney, Agent, or Firm* — Renner, Otto, Boisselle & Sklar, LLP

(57) ABSTRACT

An illumination apparatus including: a power supply circuit which outputs a DC power obtained by rectifying an AC voltage and stepping up the rectified voltage; a light source unit having semiconductor light emitting elements turned on by the DC power; and a housing formed of a conductive material that is grounded through a ground path and on which the power supply circuit and the light source unit are mounted. When one of power feed lines is cut off, the light emitting elements are supplied with an AC power from an AC power source through the ground path and a stray capacitance formed between the light source unit and the housing, and a forward voltage of the light emitting elements has a light emission level hardly recognizable.

5 Claims, 3 Drawing Sheets

ILLUMINATION APPARATUS

FIELD OF THE INVENTION

The present invention relates to an illumination apparatus using semiconductor light emitting elements such as light emitting diodes (LEDs) as light sources.

BACKGROUND OF THE INVENTION

Recently, instead of a fluorescent lamp or bulb having a filament, a semiconductor light emitting element such as an LED with a long life and low power consumption is used as a light source of an illumination apparatus.

FIG. 3 illustrates a schematic configuration of a conventional illumination apparatus B1, which includes a power supply circuit 101, a light source unit 102 and an apparatus housing 104.

The power supply circuit 101 consists of a non-isolated AC/DC converter to output a DC power obtained by rectifying (full-wave rectifying or half-wave rectifying) an AC voltage Vi2 inputted from an AC power source 110 and stepping up the rectified voltage.

The light source unit 102 includes a substrate (not shown) mounted with semiconductor light emitting elements 103 connected, e.g., in series, and a DC voltage Vo2 outputted from the power supply circuit 101 is applied between both ends of the series circuit of the semiconductor light emitting elements 103. That is, the semiconductor light emitting elements 103 are turned on by the DC power supplied from the power supply circuit 101.

In addition, an AC power is supplied to the input of the power supply circuit 101 from the AC power source 110 through a pair of power feed lines Wb1 and Wb2, and a switch SW100 is located in the power feed line Wb2. The switch SW100 constitutes a single pole switch of the AC power source such as a wall switch for home, and by turning on/off the switch SW100, it is possible to allow or block the power supply from the AC power source 110 to the power supply circuit 101 to switch on/off the semiconductor light emitting elements 103.

Further, the apparatus housing 104 is formed of a conductive material such as metal, and the power supply circuit 101 and the light source unit 102 are mounted on the apparatus housing 104. In FIG. 3, only a part of the apparatus housing 104 is illustrated.

In addition, the AC power source 110 has a ground phase, and the ground phase (on the side of the power feed line Wb2 in which the switch SW100 is located) is grounded through a ground path Wb3. Further, the apparatus housing 104 of the illumination apparatus B1 is also grounded through a ground path Wb4. That is, the apparatus housing 104 has the same potential as the ground phase of the AC power source 110.

However, in the conventional illumination apparatus B1, even in a state where the switch SW100 is turned off, the semiconductor light emitting elements 103 emit light slightly to generate slight light emission and there was a problem such that the semiconductor light emitting elements 103 seem to be turned on.

This is due to a stray capacitance Cb generated between the light source unit 102 and the apparatus housing 104 when the light source unit 102 is attached in the vicinity of the apparatus housing 104. Specifically, even in a state where the switch SW100 is turned off, there exists a current loop of the AC power source 110—the power feed line Wb1—the power supply circuit 101—the semiconductor light emitting elements 103—the stray capacitance Cb—the apparatus housing 104—the ground path Wb4—the ground path Wb3—the AC power source 110. The current from the AC power source 110 flows into the current loop, and the semiconductor light emitting elements 103 emit light slightly by this current loop even in a state where the switch SW100 is turned off. In addition, the stray capacitance Cb is formed by a stray capacitance between the semiconductor light emitting elements 103 and the apparatus housing 104, a stray capacitance between the substrate on which the semiconductor light emitting elements 103 are mounted and the apparatus housing 104, a stray capacitance between a case of the light source unit 102 and the apparatus housing 104 and the like.

In order to solve this problem, in the conventional illumination apparatus B1, as shown in FIG. 3, in the light source unit 102, capacitors C100 are connected with the semiconductor light emitting elements 103 in parallel. This configuration is intended, by using the capacitors C100, to limit the stray capacitance Cb generated between the light source unit 102 and the apparatus housing 104 and to block the current loop including the semiconductor light emitting elements 103, thereby preventing slight light emission.

However, in case of using the capacitors C100, at least the capacitors C100 of the same number as the semiconductor light emitting elements 103 are necessary, and the illumination apparatus B1 includes a large number of components. Accordingly, it becomes a factor of inhibiting miniaturization and cost reduction.

In addition, if the switch SW100 is located in the power feed line Wb1 that is not grounded among the power feed lines Wb1 and Wb2, since the current loop is not formed, it is possible to prevent slight light emission. However, the switch SW100 needs to be wired considering a ground situation and it was difficult to obtain a good workability.

SUMMARY OF THE INVENTION

In view of the above, the present invention provides an illumination apparatus capable of suppressing slight light emission in a small size and with a low cost and improving workability.

In accordance with an embodiment of the present invention, there is provided an illumination apparatus including: a non-isolated power supply circuit which outputs a DC power obtained by rectifying an AC voltage inputted from an AC power source having a ground phase through a pair of power feed lines and stepping up the rectified voltage; a light source unit having one or more semiconductor light emitting elements which are turned on by the DC power outputted from the power supply circuit; and an apparatus housing which is formed of a conductive material that is grounded through a ground path and on which the power supply circuit and the light source unit are mounted.

When only one of power feed lines is cut off, the semiconductor light emitting elements are supplied with an AC power from the AC power source through the ground path and a stray capacitance which is formed between the light source unit and the apparatus housing, and a forward voltage of the semiconductor light emitting elements supplied with the AC power has a light emission level that cannot be recognized by a human eye.

As described above, the present invention has an effect of suppressing slight light emission in small size and with low cost and improving workability.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, an embodiment of the present invention will be described with reference to the accompanying drawings which form a part hereof.

Figure 1:
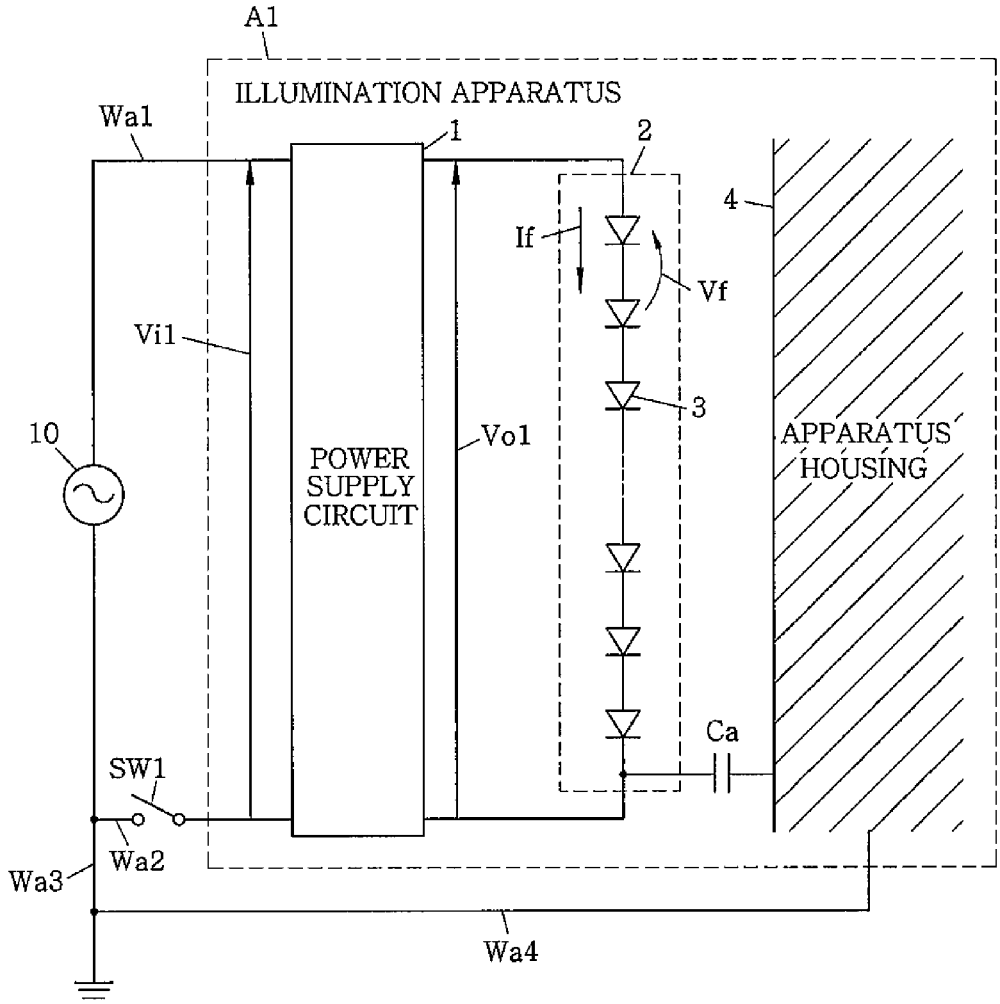
FIG. 1 is a circuit diagram showing a schematic configuration of an illumination apparatus in accordance with an embodiment of the present invention.

FIG. 1 shows a schematic configuration of an illumination apparatus A1 of this embodiment, which includes a power supply circuit 1, a light source unit 2 and an apparatus housing 4.

The power supply circuit 1 consists of a non-isolated AC/DC converter to output a DC power obtained by rectifying (full-wave rectifying or half-wave rectifying) an AC voltage Vi1 inputted from an AC power source 10 and stepping up the rectified voltage. Also, the non-isolated AC/DC converter has a configuration in which there is no isolation between input and output, and since the non-isolated AC/DC converter having a step-up function is well known, a detailed description thereof will be omitted.

The light source unit 2 includes a substrate (not shown) mounted with semiconductor light emitting elements 3 connected in series, and a DC voltage Vo1 outputted from the power supply circuit 1 is applied between both ends of the series circuit of the semiconductor light emitting elements 3. That is, the semiconductor light emitting elements 3 are turned on by the DC power supplied from the power supply circuit 1. In this embodiment, the semiconductor light emitting elements 3 are formed of LEDs, but the form of the semiconductor light emitting elements is not limited to the LED.

In addition, an AC power is supplied to the input of the power supply circuit 1 from the AC power source 10 through a pair of power feed lines Wa1 and Wa2, and a switch SW1 is located in the power feed line Wa2. The switch SW1 constitutes a single pole switch of the AC power source such as a wall switch for home, and by turning on/off the switch SW1, it is possible to allow or block the power supply from the AC power source 10 to the power supply circuit 1 to switch on/off the semiconductor light emitting elements 3.

Further, the apparatus housing 4 is formed of a conductive material such as metal, and the power supply circuit 1 and the light source unit 2 are mounted on the apparatus housing 4. In FIG. 1, only a part of the apparatus housing 4 is illustrated.

In addition, the AC power source 10 has a single phase of 100V with a ground phase, and the ground phase (on the side of the power feed line Wa2 in which the switch SW1 is located) is grounded through a ground path Wa3. Further, the apparatus housing 4 of the illumination apparatus A1 is also grounded through a ground path Wa4. That is, the apparatus housing 4 has the same potential as the ground phase of the AC power source 10.

Figure 2:
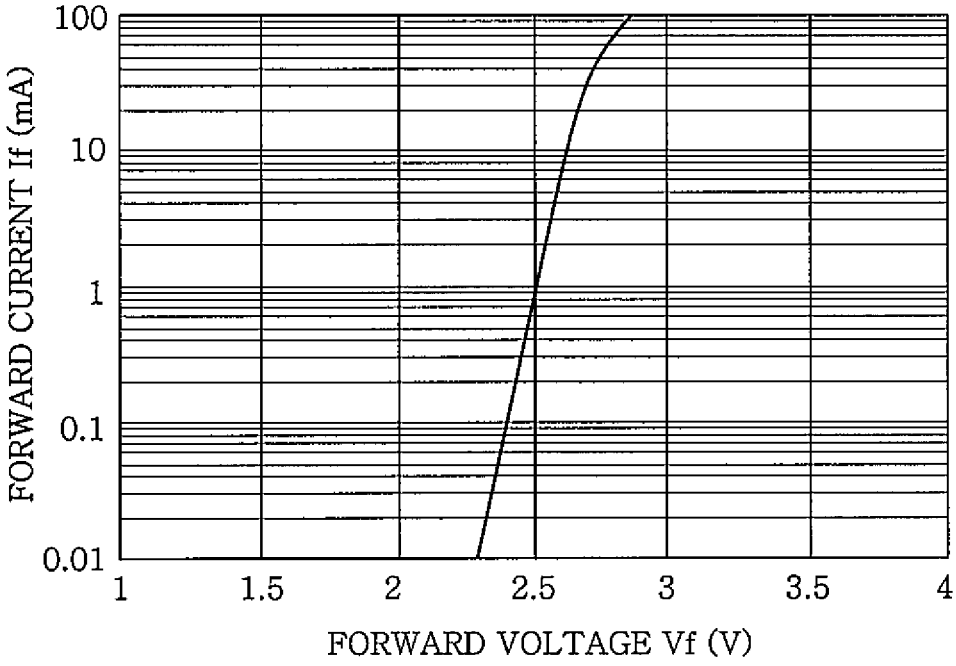
FIG. 2 shows forward voltage-current characteristics of semiconductor light emitting elements.
Figure 3:
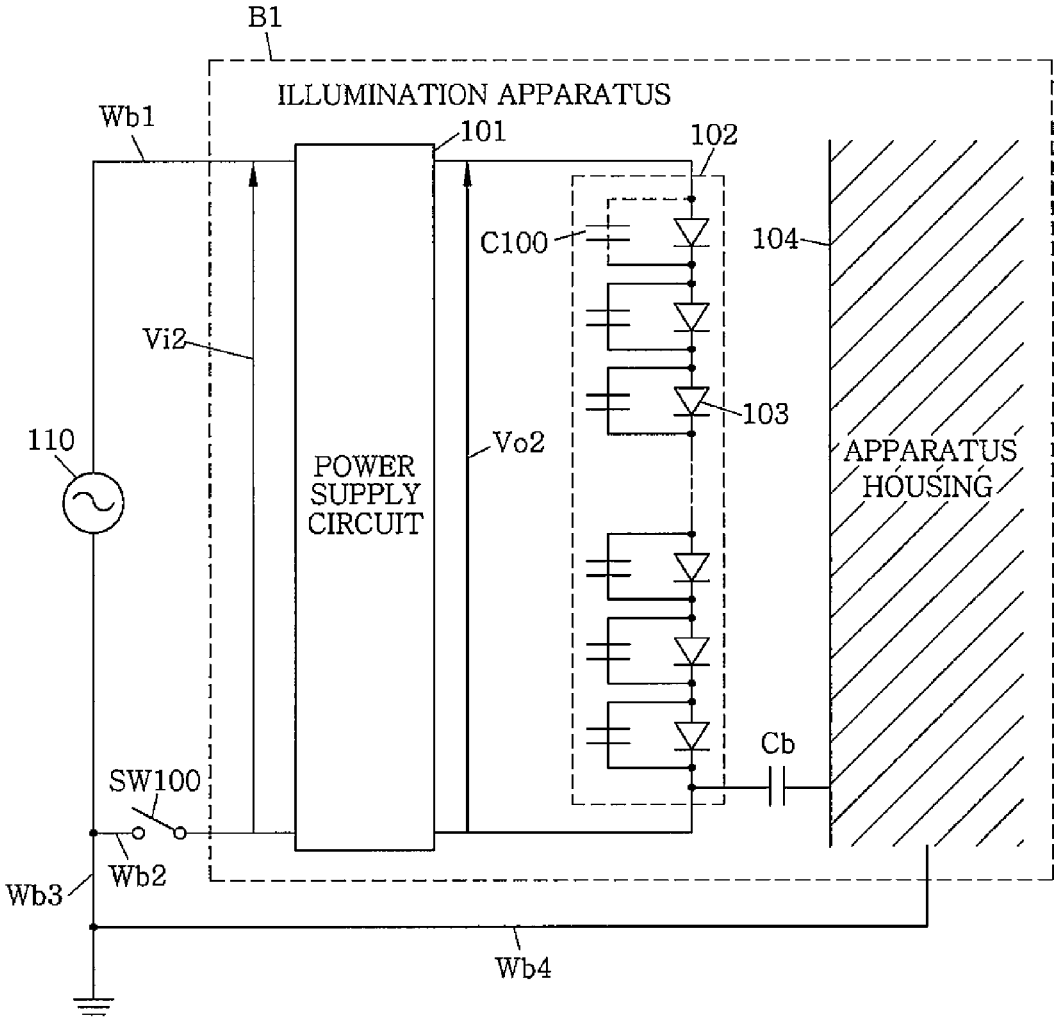
FIG. 3 (PRIOR ART)
FIG. 3 is a circuit diagram showing a schematic configuration of a conventional illumination apparatus.

FIG. 2 shows forward voltage-current characteristics of the semiconductor light emitting elements 3. In this embodiment, when the switch SW1 is turned on, a forward current If of the semiconductor light emitting elements 3 is set to 100 mA and a light emission level of the semiconductor light emitting elements 3 is adjusted to a predetermined brightness level. Specifically, the DC voltage Vo1 outputted from the power supply circuit 1 is set such that a forward voltage Vf of each of the semiconductor light emitting elements 3 is about 2.9 V. For example, if the number of the semiconductor light emitting elements 3 connected in series is ninety four (94), the power supply circuit 1 outputs the DC voltage Vo1 of about 273V, so that the forward voltage Vf of each of the semiconductor light emitting elements 3 is set to about 2.9 V, and the forward current If is set to 100 mA. In this way, when the switch SW1 is turned on, the light emission level of the semiconductor light emitting elements 3 is adjusted to the predetermined brightness level.

Next, when the switch SW1 is turned off, the power supply from the AC power source 10 to the power supply circuit 1 is cut off. However, in the illumination apparatus A1, since the light source unit 2 is attached in the vicinity of the apparatus housing 4, a stray capacitance Ca occurs between the light source unit 2 and the apparatus housing 4. Accordingly, even in a state where the switch SW1 is turned off, there exists a current loop of the AC power source 10—the power feed line Wa1—the power supply circuit 1—the semiconductor light emitting elements 3—the stray capacitance Ca—the apparatus housing 4—the ground path Wa4—the ground path Wa3—the AC power source 10. The current from the AC power source 10 flows into the current loop, and the current flows through the semiconductor light emitting elements 3 within this current loop.

At this time, the AC voltage is applied to the semiconductor light emitting elements 3, and a period during which a forward voltage is applied and a period during which a reverse voltage is applied are repeated alternately every half cycle of the AC voltage. In addition, the stray capacitance Ca is formed by a stray capacitance between the semiconductor light emitting elements 3 and the apparatus housing 4, a stray capacitance between the substrate on which the semiconductor light emitting elements 3 are mounted and the apparatus housing 4, a stray capacitance between a case of the light source unit 2 and the apparatus housing 4 and the like.

Here, the semiconductor light emitting elements 3 in accordance with the present embodiment emit light that can be recognized by the human eye if the forward current If is equal to or greater than 0.01 mA. In this case, in a state where the switch SW1 is turned off and the above current loop is formed, the forward current If of the semiconductor light emitting elements 3 is set to be less than 0.01 mA such that the light emitted from the semiconductor light emitting elements 3 cannot be recognized by the human eye.

In FIG. 2, when the forward current If=0.01 mA is flowing through the semiconductor light emitting elements 3, the forward voltage Vf becomes about 2.3 V. Therefore, taking into account individual differences of the semiconductor light emitting elements 3, the accuracy of the AC voltage Vi1 of the AC power source 10 and the like, the number of the semiconductor light emitting elements 3 connected in series is set such that the forward voltage Vf of each of the semiconductor light emitting elements 3 is equal to or less than 1.5 V. For example, if an effective value of the AC voltage Vi1 is 100 V, the maximum amplitude of the AC voltage Vi1 becomes 141 V. Therefore, if the number of the semiconductor light emitting elements 3 connected in series is equal to or greater than ninety four (94), the maximum value of the forward voltage Vf of each of the semiconductor light emitting elements 3 is equal to or less than 1.5 V, and the maximum value of the forward current If of the semiconductor light emitting elements 3 can be set to be less than 0.01 mA.

Although a case where a plurality of the semiconductor light emitting elements 3 are connected in series has been described in the embodiment of the present invention, without being limited thereto, the semiconductor light emitting elements 3 may be configured by, e.g., one light emitting element or parallel or series-parallel connection of multiple light emitting elements.

In this way, the illumination apparatus A1, when the switch SW1 is turned off, can maintain the light emission level (slight light emission level) of the semiconductor light emitting elements 3 within the above current loop at a level which cannot be recognized by the human eye. In addition, there is no need for capacitors of the semiconductor light emitting elements 3 to be connected in parallel, and it is possible to achieve miniaturization and cost reduction.

In addition, by using the illumination apparatus A1, even if the switch SW1 is located in any of the power feed line Wa1 that is not grounded and the power feed line Wa2 that is grounded, it is possible to suppress the slight light emission. Therefore, even when using the single pole switch SW1, it is not necessary to consider a ground situation when wiring the switch SW1, and it is possible to obtain a good workability.

In this way, in the illumination apparatus A1 in accordance with the present embodiment, it is possible to suppress the slight light emission and improve the workability while achieving miniaturization and cost reduction.

While the invention has been shown and described with respect to the embodiments, it will be understood by those skilled in the art that various changes and modification may be made without departing from the scope of the invention as defined in the following claims.

What is claimed is:

1. An illumination apparatus comprising:

a non-isolated power supply circuit which outputs a DC power obtained by rectifying an AC voltage inputted from an AC power source having a ground phase through a pair of power feed lines and stepping up the rectified voltage;

a light source unit having one or more semiconductor light emitting elements which are turned on by the DC power outputted from the power supply circuit; and an apparatus housing which is formed of a conductive material that is grounded through a ground path and on which the power supply circuit and the light source unit are mounted, wherein when only one of the power feed lines is cut off, the semiconductor light emitting elements are supplied with an AC power from the AC power source through the ground path and a stray capacitance which is formed between the light source unit and the apparatus housing, and a forward voltage of each of the semiconductor light emitting elements supplied with the AC power has a light emission level that is not recognized by a human eye.

2. The illumination apparatus of claim 1, wherein the semiconductor light emitting elements are connected in series, and the number of the semiconductor light emitting elements that are connected in series is selected such that, when only one of the power feed lines is cut off, a forward voltage of each of the semiconductor light emitting elements supplied with the AC power has the light emission level that is not recognized by the human eye.

3. The illumination apparatus of claim 1, wherein when only one of the power feed lines is cut off, the semiconductor light emitting elements are supplied with an AC voltage Vi from the AC power source through the ground path and a stray capacitance which is formed between the light source unit and the apparatus housing, and a forward voltage Vf of the semiconductor light emitting elements supplied with the AC voltage Vi has a relation to a number N of the semiconductor light emitting elements connected in series defined by the equation $Vf \leq \sqrt{2}Vi/N$ such that each of the semiconductor light emitting elements has the light emission level that is not recognized by the human eye.

4. The illumination apparatus of claim 1, wherein the semiconductor light emitting elements are connected in series, and the number of the semiconductor light emitting elements connected in series is set such that, when only one of the power feed lines is cut off, forward voltage Vf of each of the semiconductor light emitting elements supplied with the AC power is equal to or less than 1.5 V.

5. The illumination apparatus of claim 1, wherein no capacitors are connected in parallel with the semiconductor light emitting elements.

* * * * *